US011472015B2

(12) United States Patent
Liou

(10) Patent No.: US 11,472,015 B2
(45) Date of Patent: Oct. 18, 2022

(54) PRY TOOL

(71) Applicant: Tang Chou Industrial Co., Ltd., Nantou County (TW)

(72) Inventor: Mou-Tang Liou, Taichung (TW)

(73) Assignee: Tang Chou Industrial Co., Ltd., Nantou County (TW)

( * ) Notice: Subject to any disclaimer, the term of this patent is extended or adjusted under 35 U.S.C. 154(b) by 207 days.

(21) Appl. No.: 16/896,391

(22) Filed: Jun. 9, 2020

(65) Prior Publication Data

US 2021/0379749 A1 Dec. 9, 2021

(51) Int. Cl.
*B25C 11/00* (2006.01)

(52) U.S. Cl.
CPC ..... *B25C 11/00* (2013.01)

(58) Field of Classification Search
CPC ..... B25C 11/00; B66F 15/00
See application file for complete search history.

(56) References Cited

U.S. PATENT DOCUMENTS 10,344,488 B2 * 7/2019 Bridges ..... B25B 27/04

* cited by examiner

*Primary Examiner* — Nirvana Deonauth
(74) *Attorney, Agent, or Firm* — Alan D. Kamrath; Karin L. Williams; Mayer & Williams PC

(57) ABSTRACT

A pry tool includes a body having a base with a through-hole extending along a first axis and a through-slot extending perpendicularly to the first axis. The base has an arcuate bottom face defining a contact point for contacting with a working plan. A second axis intersects with the first axis at an intersection and passes through the contact point. A third axis intersects with the second axis at the center of curvature of the arcuate bottom face. An angle between the second and third axes is 5°-10°. A shank extends from the base along a fourth axis intersecting with the first axis at the intersection. An angle between the second and fourth axes is 15°-25°. A claw member is coupled to the through-slot. A fixing member is securely mounted in the through-hole and abuts against the claw member.

9 Claims, 5 Drawing Sheets

PRY TOOL

BACKGROUND OF THE INVENTION

The present invention relates to a tool and, more particularly, to a pry tool for a wood structure, with the pry tool providing a labor saving effect by a special angle design.

A wood structure produced by nailing wooden boards and wooden slats is commonly used in daily life as a pallet for transporting cargo or a wooden platform in architecture. The above wood structure can be detached by the following methods:

1. Use a wooden board or a wooden slat as a pry bar, which is laborious and could damage the detached wooden boards of the wood structure. Furthermore, the wooden slat forming the pry bar could break during application of force, causing injury to the operator.

2. Directly striking the wood structure with an iron hammer to separate the wooden slats of the wood structure. Alternatively, a hammer can be used together with a nail remover. The hammer strikes the nail remover extending into a wooden slat of the wood structure to pry the wooden slat. However, the wooden slat of the wooden structure would be injured by the hammer, and the operator has to bend down or squat during the striking operation, which is laborious.

Therefore, there are no suitable pry tools for detaching wooden structures made by nailing wooden boards and wooden slats. The operator must squat during operation, which is laborious and relatively inconvenient. Thus, a need exists for a novel pry tool that mitigates and/or obviates the above disadvantages.

BRIEF SUMMARY OF THE INVENTION

An objective of the present invention is to provide a pry tool for a wood structure, with the pry tool providing a labor saving effect by a special angle design.

A pry tool according to the present invention comprises a body, a claw member, and a fixing member. The body includes a base and a shank. The base extends along a first axis. The base includes a through-hole extending along the first axis and a through-slot extending in a radial direction perpendicular to the first axis. The base includes a side located opposite to the shank and having an arcuate bottom face. The arcuate bottom face defines a contact point configured for contacting with a working plan. A second axis intersects with the first axis and passes through the contact point. A third axis intersects with the second axis at an intersection which is the center of curvature of the arcuate bottom face. An angle between the third axis and the second axis is in a range of 5°-10°. The shank extends from the base along a fourth axis that intersects with the first axis at a common intersection where the second axis intersects with the first axis. An angle between the fourth axis and the second axis is in a range of 15°-25°. The claw member is coupled to the through-slot of the base. The fixing member is securely mounted in the through-hole and abuts against the claw member.

In an example, the angle between the third axis and the second axis is 10°.

In an example, the angle between the fourth axis and the second axis is 25°.

In an example, the shortest distance between the arcuate bottom face and the intersection of the third axis and the second axis is not larger than 25 mm.

In an example, the base includes an inner arcuate face and an outer arcuate face opposite to the inner arcuate face. The radius of curvature of the inner arcuate face is larger than the radius of curvature of the outer arcuate face.

In an example, the claw member includes an intermediate portion and two claws extending from two opposite ends of the intermediate portion, respectively. The intermediate portion is coupled in the through-slot of the base. The two claws are configured to abut against the working plane.

In an example, the fixing member is riveted in the through-hole of the base and abuts against the intermediate portion of the claw member.

In an example, the pry tool further comprises a positioning member having a positioning portion and a clamping portion connected to the positioning portion. The shank includes a first positioning hole extending along the fourth axis. The fixing member includes a second positioning hole extending along the second axis. The positioning portion of the positioning member is removably received in the first positioning hole or the second positioning hole.

In an example, the clamping portion has U-shaped cross sections.

In an example, the shank includes a limiting hole extending in a radial direction perpendicular to the fourth axis and intercommunicating with the first positioning hole. The positioning member includes a limiting portion removably coupled in the limiting hole.

Thus, based on the special angle design of the base and the shank of the body of the pry tool according to the present invention, the operator can apply force easily when the contact point defined by the arcuate bottom face is used as a fulcrum on the working plane. Furthermore, the positioning member of the pry tool according to the present invention can clamp the wooden slat, such that the operator can press against the to-be-nailed wooden board (which has been disposed on the wooden slat) through the claw member.

The present invention will become clearer in light of the following detailed description of illustrative embodiments of this invention described in connection with the drawings.

DETAILED DESCRIPTION OF THE INVENTION

Figure 1:
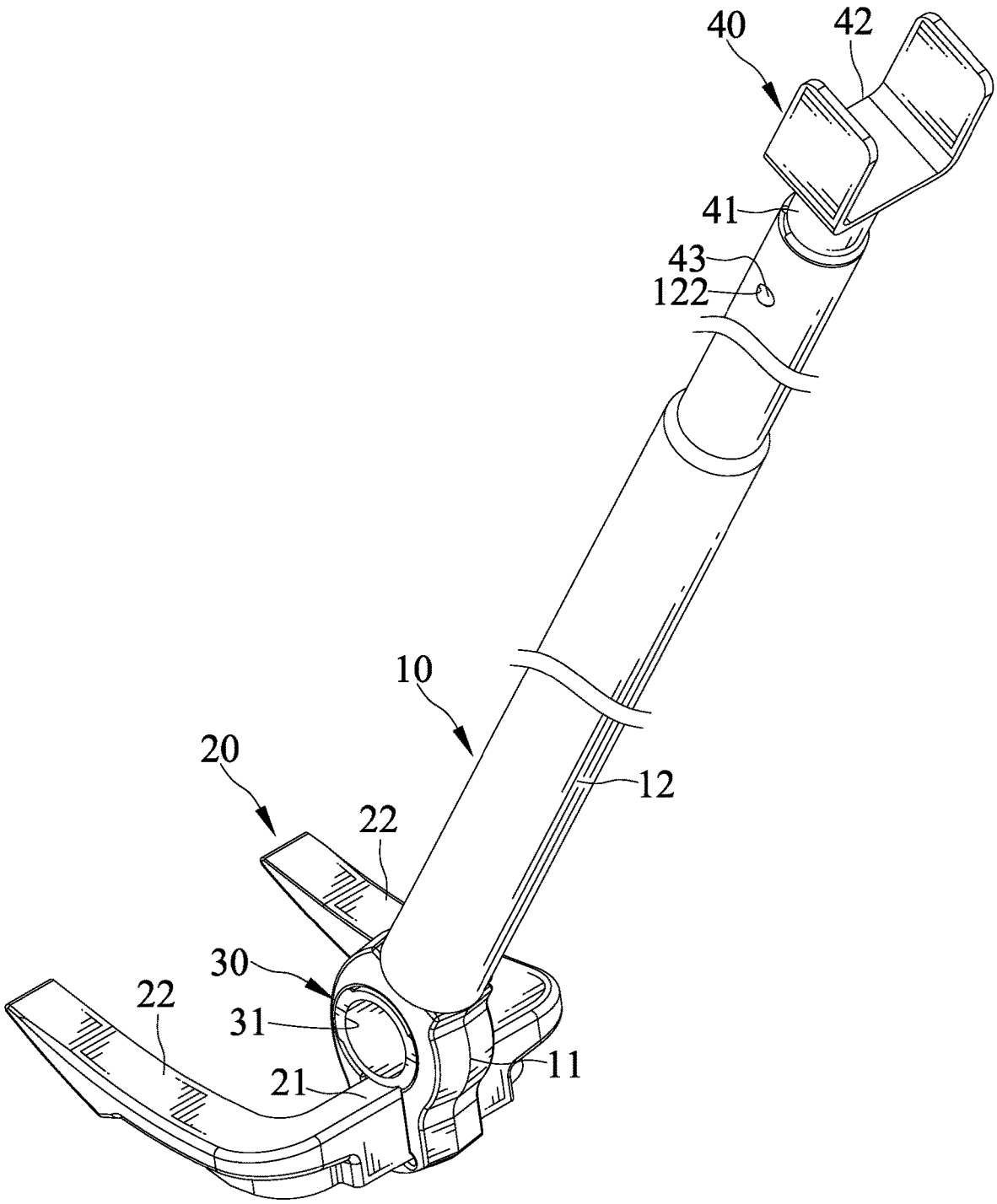
FIG. 1 is a perspective view of a pry tool of an embodiment according to the present invention.
Figure 2:
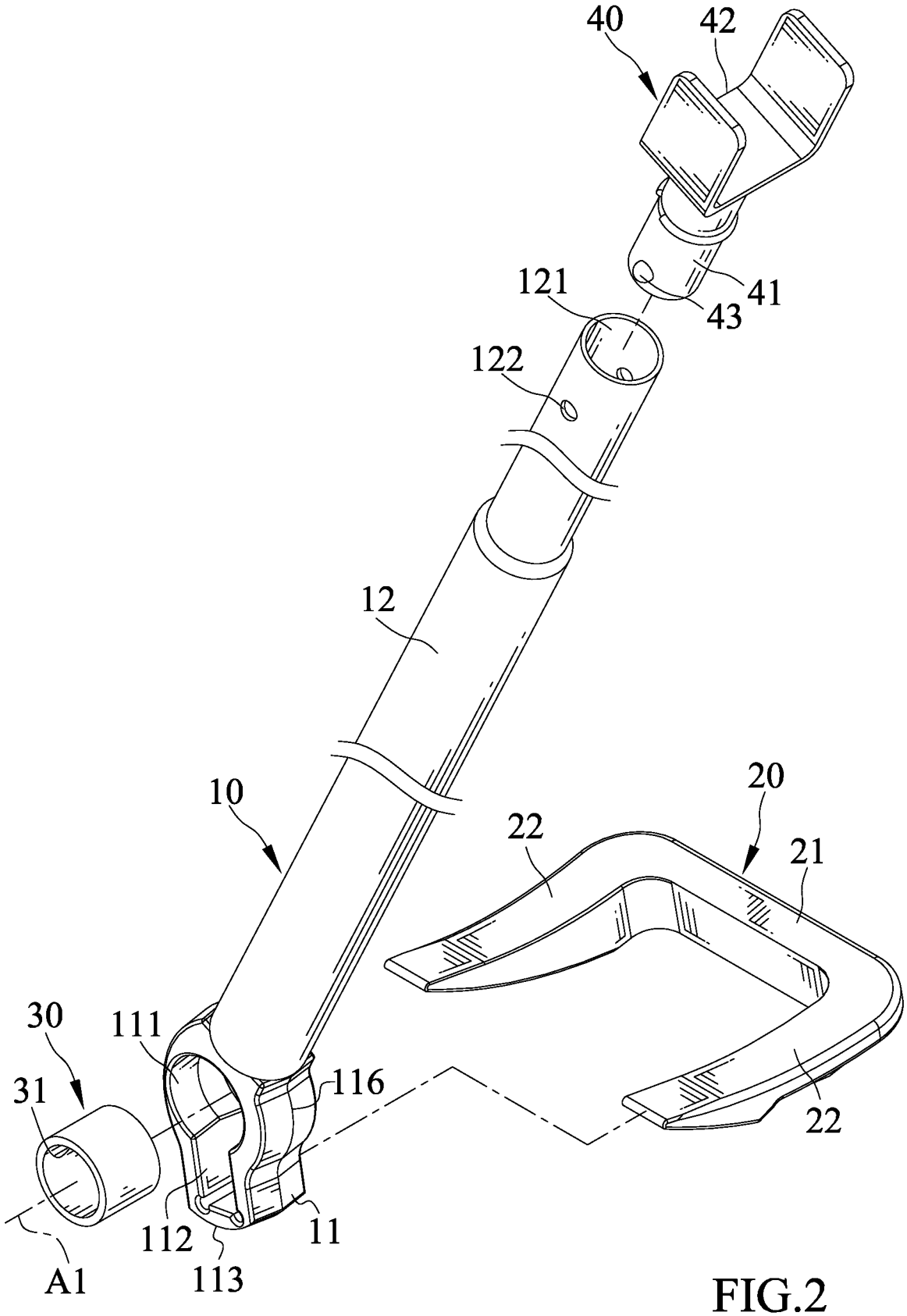
FIG. 2 is an exploded, perspective view of the pry tool of FIG. 1.
Figure 3:
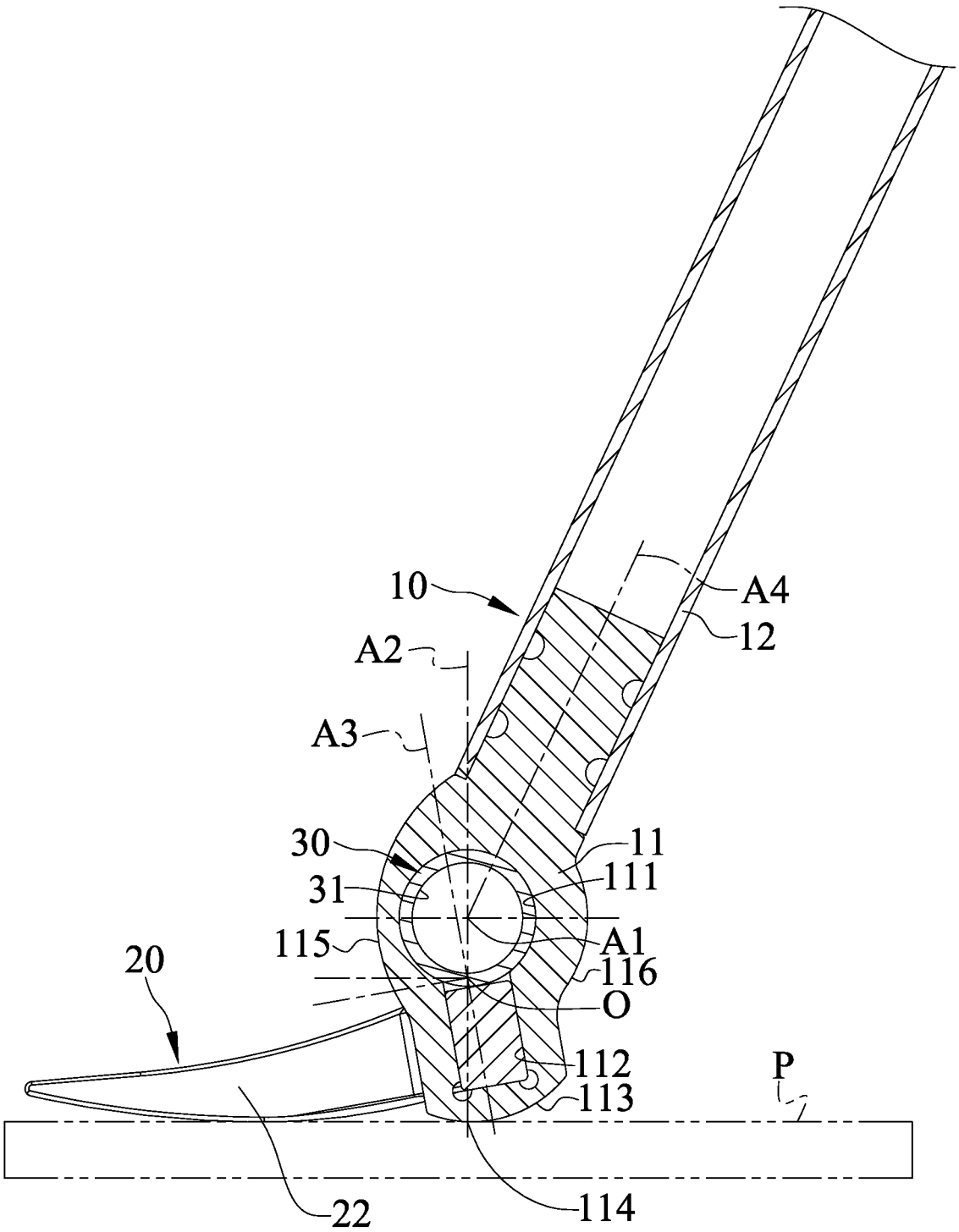
FIG. 3 is a cross sectional view of the pry tool of FIG. 1.
Figure 4:
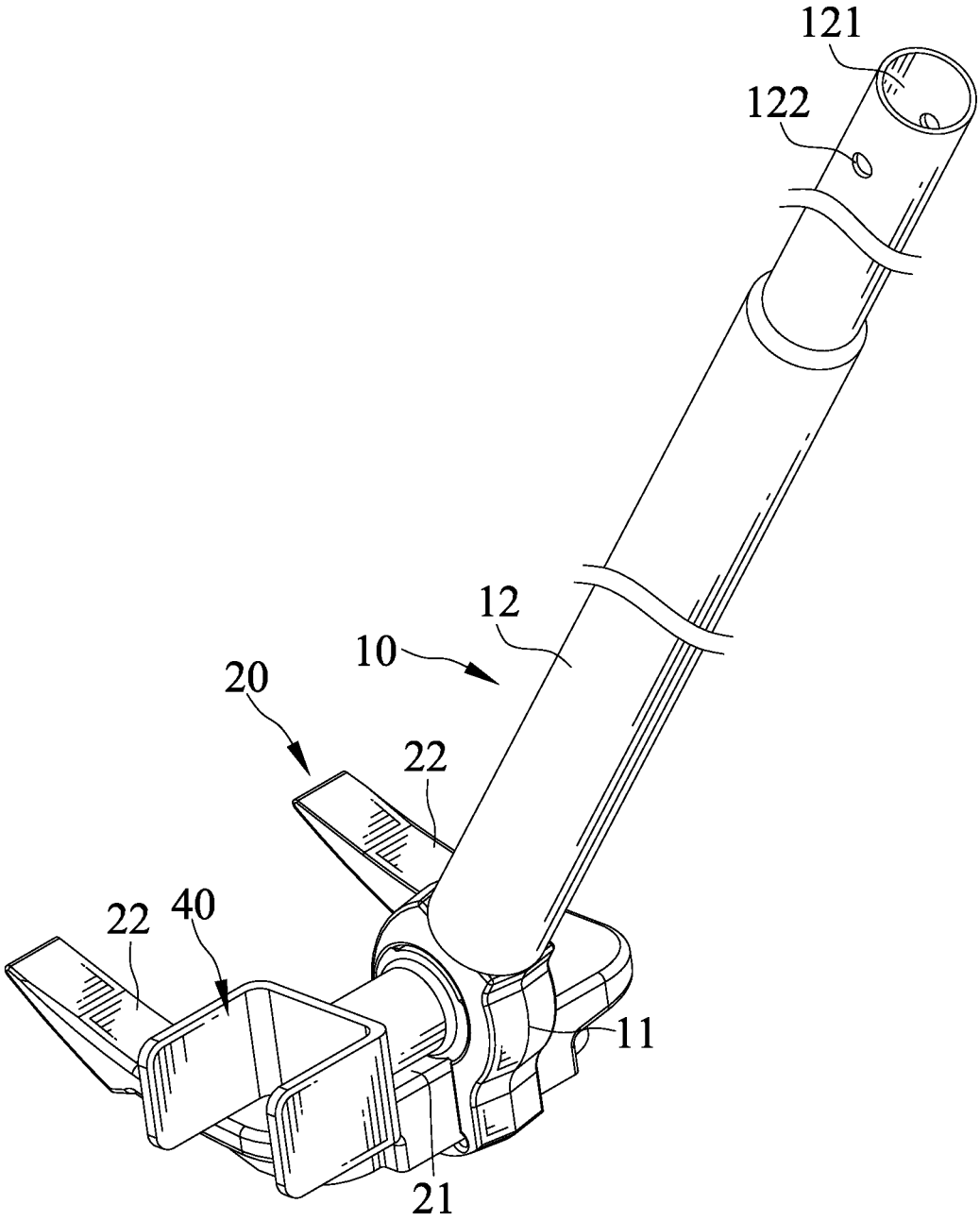
FIG. 4 is another perspective view of the pry tool of FIG. 1 with a positioning member connected to a fixing member.

With reference to FIGS. 1-5, a pry tool of an embodiment according to the present invention includes a body 10, a claw member 20 connected to the body 10, and a fixing member 30 securely mounted to the body 10. The body 10 includes a base 11 and a shank 12. The base 11 includes a through-hole 111 extending along a first axis A1 and a through-slot 112 extending in a radial direction perpendicular to the first axis A1. The base 11 includes a side located opposite to the shank 12 and having an arcuate bottom face 113. The arcuate bottom face 113 defines a contact point 114 configured for contacting with a working plane P. The working plane P can be a top face of a wooden slat W or any face providing support. A second axis A2 intersects with the first axis A1 and passes through the contact point 114. A third axis A3 intersects with the second axis A2 at an intersection O which can be the center of curvature of the arcuate bottom face 113. An angle between the third axis A3 and the second axis A2 is in a range of 5° 40°. In the embodiment shown, the angle between the third axis A3 and the second axis A2 is 10°. Furthermore, the shortest distance between the arcuate bottom face 113 and the intersection O of the third axis A3 and the second axis A2 is not larger than 25 mm in this embodiment.

The base 11 further includes an inner arcuate face 115 and an outer arcuate face 116 opposite to the inner arcuate face 115. The radius of curvature of the inner arcuate face 115 is larger than the radius of curvature of the outer arcuate face 116. The shank 12 extends from the base 11 along a fourth axis A4 that intersects with the first axis A1 at a common intersection where the second axis A2 intersects with the first axis A1. An angle between the fourth axis A4 and the second axis A2 is in a range of 15°-25°. In the embodiment shown, the angle between the fourth axis A4 and the second axis A2 is 25°.

The claw member 20 includes an intermediate portion 21 and two claws 22 extending from two opposite ends of the intermediate portion 21, respectively. The intermediate portion 21 is coupled in the through-slot 112 of the base 11. The two claws 22 are configured to abut against the working plane P.

The fixing member 30 is securely mounted to the through-hole 111 of the base 11 and abuts against the claw member 20. In this embodiment, the fixing member 30 is riveted in the through-hole 111 and abuts against the intermediate portion 21 of the claw member 20, avoiding the claw member 20 from disengaging from the body 10.

Furthermore, the pry tool of the embodiment according to the present invention can further include a positioning member 40 having a positioning portion 41 and a clamping portion 42 connected to the positioning portion 41. The shank 12 of the body 10 includes a first positioning hole 121 extending along the fourth axis A4. The fixing member 30 includes a second positioning hole 31 extending along the second axis A2. The positioning portion 41 of the positioning member 40 is removably connected to the first positioning hole 121 (see FIG. 1) or the second positioning hole 31 (see FIG. 4). In this embodiment, the clamping portion 42 has U-shaped cross sections for clamping the wooden slat W.

Figure 5:
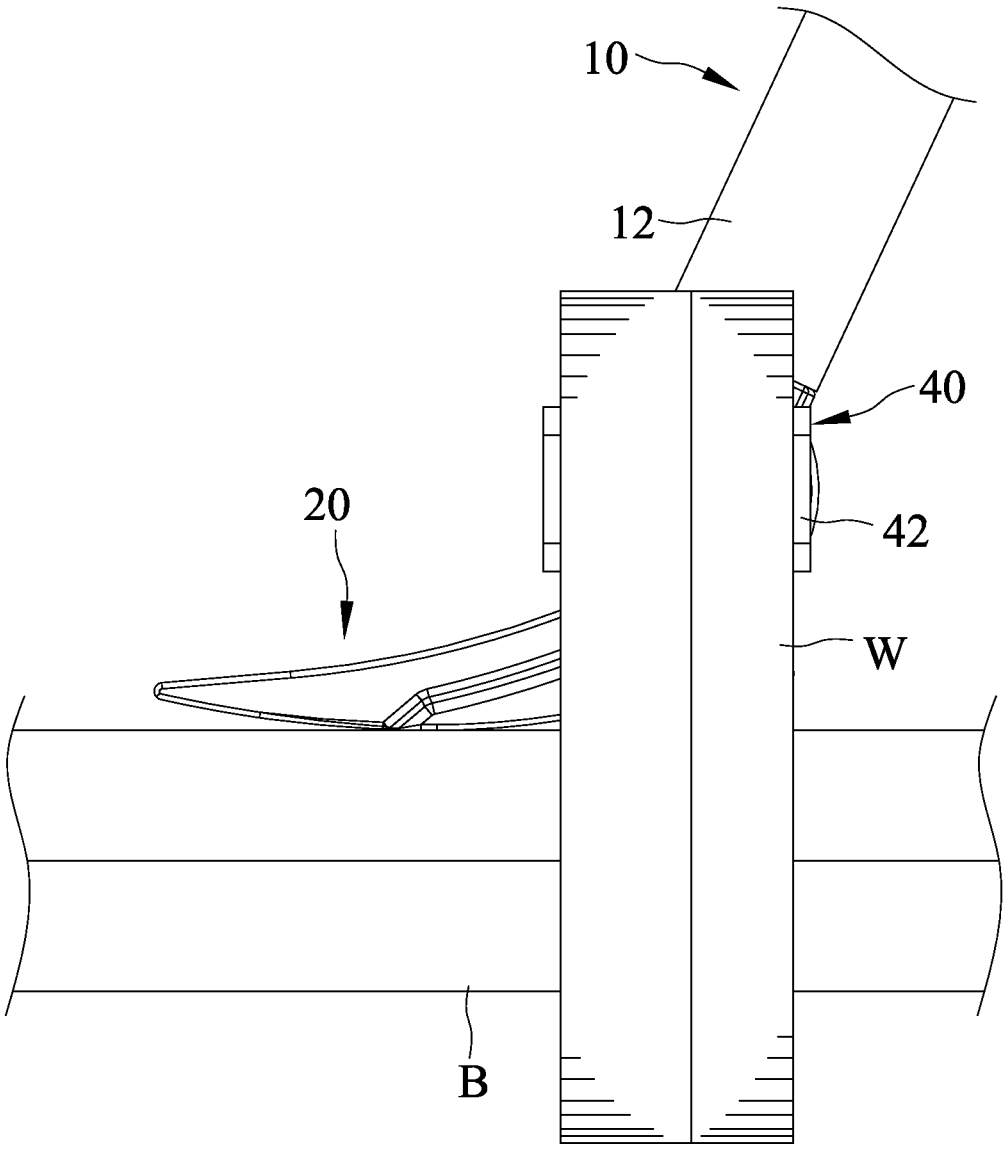
FIG. 5 is a diagrammatic view illustrating use of the pry tool of FIG. 1.

The shank 12 of the body 10 includes a limiting hole 122 extending in a radial direction perpendicular to the fourth axis A4 and intercommunicating with the first positioning hole 121. The positioning member 40 includes a limiting portion 43 removably coupled in the limiting hole 122. Thus, the positioning member 40 can be positioned in the limiting hole 122. Accordingly, when the positioning member 40 is not required, the positioning portion 41 of the positioning member 40 is coupled with the first positioning hole 121. On the other hand, when the positioning member 40 is required, the positioning portion 41 of the positioning member 40 is coupled with the second positioning hole 31 of the fixing member 30, such that the positioning portion 41 of the positioning member 40 extends along the first axis A1. As shown in FIG. 5, in this case, the clamping portion 42 of the positioning member 40 can clamp the wooden slat W, and the operator can apply a force using the body 10 as a fulcrum to thereby press against a to-be-nailed wooden board B (that has been disposed on the wooden slat W) through the claw member 20. Thus, the pry tool of this embodiment provides a function of tightly pressing the wooden board B, which is advantageous when laying a wooden floor.

In view of the foregoing, based on the special angle design of the base 11 and the shank 12 of the body 10 of the pry tool according to the present invention, the operator can apply force easily when the contact point 114 defined by the arcuate bottom face 113 is used as a fulcrum on the working plane P. Furthermore, the positioning member 40 of the pry tool according to the present invention can clamp the wooden slat W, such that the operator can press against the to-be-nailed wooden board B (which has been disposed on the wooden slat W) through the claw member 20.

Although specific embodiments have been illustrated and described, numerous modifications and variations are still possible without departing from the scope of the invention. The scope of the invention is limited by the accompanying claims.

The invention claimed is:

1. A pry too comprising;

a body including a base and a shank, wherein the base extends along a first axis, wherein the base includes a through-hole extending along the first axis and a through-slot extending in a radial direction perpendicular to the first axis, wherein the base includes a side located opposite to the shank and having an arcuate bottom face, wherein the arcuate bottom face defines a contact point configured for contacting with a working plane, wherein a second axis intersects with the first axis and passes through the contact point, wherein a third axis intersects with the second axis at an intersection which is a center of curvature of the arcuate bottom face, wherein an angle between the third axis and the second axis is in a range of 5°-10°, wherein the base includes an inner arcuate face and an outer arcuate face opposite to the inner arcuate face, and wherein a radius of curvature of the inner arcuate face is larger than a radius of curvature of the outer arcuate face, wherein the shank extends from the base along a fourth axis that intersects with the first axis at a common intersection where the second axis intersects with the first axis, and wherein an angle between the fourth axis and the second axis is in a range of 15°-25°;

a claw member coupled to the through-slot of the base; and a fixing member securely mounted in the through-hole and abutting against the claw member.

2. The pry tool as claimed in claim 1, wherein the angle between the third axis and the second axis is 10°.

3. The pry tool as claimed in claim 1, wherein the angle between the fourth axis and the second axis is 25°.

4. The pry tool as claimed in claim 1, wherein a shortest distance between the arcuate bottom face and the intersection of the third axis and the second axis is not larger than 25 mm.

5. The pry tool as claimed in claim 1, wherein the claw member includes an intermediate portion and two claws extending from two opposite ends of the intermediate portion, respectively, wherein the intermediate portion is coupled in the through-slot of the base, and wherein the two claws are configured to abut against the working plane.

6. The pry tool as claimed in claim 5, wherein the fixing member is riveted in the through-hole of the base and abuts against the intermediate portion of the claw member.

7. A pry tool comprising:

a body including a base and a shank, wherein the base extends along a first axis, wherein the base includes a through-hole extending along the first axis and a through-slot extending in a radial direction perpendicular to the first axis, wherein the base includes a side located opposite to the shank and having an arcuate bottom face, wherein the arcuate bottom face defines a contact point configured for contacting with a working plane, wherein a second axis intersects with the first axis and passes through the contact point, wherein a third axis intersects with the second axis at an intersection which is a center of curvature of the arcuate bottom face, wherein an angle between the third axis and the second axis is in a range of 5°-4°, wherein the shank extends from the base along a fourth axis that intersects with the first axis at a common intersection where the second axis intersects with the first axis and wherein an angle between the fourth axis and the second axis is in a range of 15°-25°;

a claw member coupled to the through-slot of the base;

a fixing member securely mounted in the through-hole and abutting against the claw member; and a positioning member having a positioning portion and a clamping portion connected to the positioning portion, wherein the shank includes a first positioning hole extending along the fourth axis, wherein the fixing member includes a second positioning hole extending along the second axis, and wherein the positioning portion of the positioning member is removably received in the first positioning hole or the second positioning hole.

8. The pry tool as claimed in claim 7, wherein the clamping portion has U-shaped cross sections.

9. The pry tool as claimed in claim 7, wherein the shank includes a limiting hole extending in a radial direction perpendicular to the fourth axis and intercommunicating with the first positioning hole, and wherein the positioning member includes a limiting portion removably coupled in the limiting hole.

* * * * *